United States Patent [19]

Waymouth

[11] Patent Number: 4,841,196

[45] Date of Patent: Jun. 20, 1989

[54] TWO-FILAMENT LAMP AND OPERATING CIRCUIT AND METHOD FOR DESIGNING SAME

[75] Inventor: John F. Waymouth, Marblehead, Mass.

[73] Assignee: GTE Products Corporation, Danvers, Mass.

[21] Appl. No.: 130,835

[22] Filed: Dec. 9, 1987

[51] Int. Cl.[4] ..... H05B 39/10

[52] U.S. Cl. ..... 315/65; 315/67; 315/89; 315/119; 313/316

[58] Field of Search ..... 315/65, 66, 67, 71, 315/90, 89, 192, 119, 224; 313/236, 316

[56] References Cited

U.S. PATENT DOCUMENTS

| | | | |
|---|---|---|---|
| 2,161,443 | 6/1939 | Warshawsky | 315/65 |
| 2,862,147 | 11/1958 | Conti | 315/67 |
| 3,319,115 | 5/1967 | Smith | 315/67 |
| 3,327,162 | 6/1967 | Wright | 315/65 |
| 3,458,756 | 7/1969 | Kotsch | 315/65 |
| 3,697,802 | 10/1972 | Demas | 315/65 |
| 3,725,728 | 4/1973 | King | 315/65 |
| 4,580,079 | 4/1986 | Koo | 315/65 |

FOREIGN PATENT DOCUMENTS

| | | | |
|---|---|---|---|
| 2110486 | 6/1983 | United Kingdom | 315/89 |

OTHER PUBLICATIONS

Gaston, Fail-safe light bulb, 6/1969, 135, IBM.

*Primary Examiner*—David K. Moore

*Assistant Examiner*—Michael Razavi

*Attorney, Agent, or Firm*—Joseph S. Romanow

[57] ABSTRACT

A two-filament incandescent lamp and operating circuit well suited to lighting applications requiring high service reliability. In the lamp, the rated operating voltage of the second filament is greater than that of the first filament. In the operating circuit, there is an inductive reactance in series with the lamp and, in one aspect of the invention, an electrical connection across the lamp terminals for measuring the operating voltage of the lamp. After the power and rated wattage of both lamp filaments have been selected, matched values of inductive reactance and open circuit voltage of the operating circuit can be uniquely determined such that the following advantages are obtained. When the first lamp filament fails, the second filament comes into full brilliance. In a preferred embodiment of the invention, there will be no significant change in the luminous output of the lamp before and after failure of the first filament. A positive indication of the failure of the first filament will be provided via the electrical connection across the lamp terminals. Maintenance personnel, perhaps remotely situated, may replace the lamp prior to failure of the second filament so that service will not be interrupted. In another aspect of the invention, the electrical connection across the lamp terminals is not included in the operating circuit. In yet another aspect of the invention, a method of designing a two-filament lamp and operating system having optimum efficiency is described.

17 Claims, 2 Drawing Sheets

TWO-FILAMENT LAMP AND OPERATING CIRCUIT AND METHOD FOR DESIGNING SAME

TECHNICAL FIELD

This invention relates to the field of incandescent lamps having two or more filaments and operating circuits for employment therewith and, more particularly, to two-filament lamps employed in lighting applications where highly reliable service is required.

BACKGROUND ART

There are numerous lighting applications requiring a high degree of service reliability. Traffic signals, navigational aids, emergency exit lighting, vehicle headlamps, display lamps, security lighting, and certain outdoor lighting, such as street or runway lamps, are examples of applications where failure of a lamp to perform its intended function may be hazardous to those who depend on the lamp or its associated equipment for information and/or illumination.

Incandescent lamps are frequently employed in highly reliable service applications because of their simplicity, versatility, and low cost. One way to insure service reliability is to replace each lamp with a new lamp before the filament of the original lamp has failed. The design life of a filament is a statistical characteristic so that lamp replacement necessarily must occur significantly before the mean or expected filament life in order to insure service to a high degree. Since the cost of replacement may exceed the cost of the lamp, this maintenance policy is expensive even if there is a market for the partially expired lamp.

Incandescent lamps having two or more filaments such that the second filament is automatically brought into service (or into full service) upon failure of the first filament are known in the prior art. The concept of providing a second or back-up filament is sound providing there is a cost-effective way of detecting when the first filament has failed so that lamp replacement may be made before the backup filament also fails. As will be seen in the following examples, means for detecting failure of the first filament in the prior art are lacking in the sense that detection is both costly and inconvenient, typically requiring on-site visual inspection of the lamp in operation.

In U.S. Pat. No. 2,161,443, issued on June 6, 1939, to Warshawsky, there is disclosed an incandescent lamp having multiple filaments such that upon burnout or destruction of one of the filaments, a reserve filament is automatically brought into operation, thus allowing further use of the lamp. The basic notion is to extend the life of the lamp by means of one or more reserve filaments rather than to maintain reliability.

In U.S. Pat. No, 1,859,661, issued May 24, 1932, to Falge, there is disclosed a lamp having an auxiliary filament primarily intended for an automobile headlamp application. In the event of burnout or breakage of the primary filament, the auxiliary filament is automatically illuminated with brightness sufficient to serve as a visual marker so that the width and position of the vehicle can be accurately determined by an observer. The auxiliary filament provides less illumination than the primary filament in order that failure of the primary filament may be ascertained by visual inspection.

There are various lamps of the prior art which are specially designed to be electrically connected in series with lamps of the same type. In the event of a filament failure in one lamp, the electrical current continues to flow through an alternate path in the affected lamp so that the remaining lamps of the series arrangement continue to operate. Various methods are known for activating the alternate path upon the failure of the primary filament, including employment of a secondary filament in the alternate circuit. See U.S. Pat. No. 1,713,752, issued May 21, 1929, to Eckhardt et al., in which the primary filament, when intact, acts as a shunt diverting most of the current away from the secondary filament.

In U.S. Pat. No. 1,717,283, issued June 11, 1929, to Van Horn et al., and U.S. Pat. No. 1,581,690, issued Apr. 20, 1926, to Powell, there are shown lamps having secondary filaments which are electrically isolated from the primary filament and its circuit until the primary filament fails whereupon arcing between the primary and secondary lead-in wires occurs and fuses the secondary filament into the primary circuit. In both patents, the preferred secondary filament has a lower luminous output than that of the primary filament so that failure of the primary filament may be readily ascertained by visual inspection. A somewhat degraded performance of the secondary filament is acceptable so that visual detection may be possible.

See also U.S. Pat. Nos. 2,084,176; 2,074,246; and 2,029,211; issued to Adler, Jr., issued on June 15, 1937; Mar. 16, 1937; and Jan. 28, 1936, respectively, and U.S. Pat. No. 3,319,115, issued May 9, 1967, to Smith. These patents disclose two-filament lamps in which both filaments are operated simultaneously such that failure of one of the filaments may be detected by visual inspection. In some cases, the light output of the partially failed lamp is noticeably different; in other cases, the light output may be the same but the appearance of the partially operational lamp is noticeably different (as when the positions of the operating filament or filaments within the lamp envelope are visible) so that visual detection is possible.

It would be a substantial advancement of the art if a two-filament incandescent lamp were provided with effective means other than visual inspection for detecting failure of the primary filament. In such a lamp, the luminous output of the secondary filament may be roughly equivalent to that of the primary filament so that there is no degradation in service after failure of the primary filament. A lamp with these capabilities will enhance safety and reliability as well as reduce maintenance costs.

DISCLOSURE OF THE INVENTION

It is an object, therefore, of the invention to obviate the deficiencies of the prior art.

Another object of the invention is to provide an incandescent lamp and operating circuit particularly suited for use in lighting applications requiring a high degree of service reliability.

A further object of the invention is to provide a two-filament lamp and operating circuit wherein the circuit components of the operating circuit are matched with the characteristics of the lamp filaments such that the second filament will be substituted for the first filament upon failure of the first filament, the lamp will provide roughly the same luminous output before and after failure of the first filament, and there may be automatic means for detecting failure of the first filament without resorting to moving parts, switches, or semiconductor devices.

Still another object of the invention is to provide an operating circuit which, when employed with a two-filament lamp in accordance with the invention, provides automatic means for alerting maintenance personnel in a location remote from the site of the lamp of the fact that the primary filament has failed and that the lamp is currently operating on its secondary filament.

Yet another object of the invention is to provide a double-filamented lamp which, when employed in combination with an operating circuit in accordance with the invention, provides a simple and inexpensive light source well suited for use in lighting applications requiring high service reliability. In preferred embodiments, the secondary filament has the same rated operating wattage as the primary filament so that the light output of the lamp remains roughly constant during the entire life of the lamp.

Still another object of the invention is to provide a substantially improved method of detecting a failure of the primary filament in a two-filament lamp. In a method in accordance with the invention, the failure of the primary filament is instantly detected by a circuit connection measuring the operating voltage across the electrical lead-in wires of the lamp. The value of this measurement may be electrically transmitted to maintenance personnel situated remotely from the site of the lamp directly or through an appropriate monitoring device. The monitoring device or circuit may trigger an alarm when the operating voltage of the second filament has been detected.

A further object of the invention is to provide a method for maintaining highly reliable service from two-filament lamps. The method is faster and less costly than that of on-site visual inspection of operating lamps typically employed in the prior art. A method in accordance with the invention may include remote signaling so that visitation of the site in order to ascertain the lamp status is unnecessary, and such method may also be "positive" in the sense that attention will be directed to a particular lamp only when the lamp needs replacement.

Another object of the invention is to provide a novel operating circuit structure including an inductive reactance, such circuit being employed in combination with a two-filament lamp, whereby improved lamp reliability and more economical maintenance may be attained in lighting applications requiring highly reliable service.

Yet another object of the invention is to provide a design method for uniquely determining design values of inductive reactance and open circuit voltage through the inductive reactance required for an operating circuit employed in combination with a double-filamented lamp having different rated operating voltages for the primary and secondary filaments. In preferred embodiments of the lamp, the operating wattages of both filaments are equal so that degradation in luminous output is eliminated when switchover from the first to second filament (as the principal light source) occurs. The method optionally includes a variation of parameters technique by which an optimum choice of the design operating voltage of the second filament may be chosen such that the total power consumed by both filaments and in the inductive reactance is a minimum when both filaments are operating.

Still a further object of the invention is to provide a novel design for a two-filament lamp and operating circuit for service in lighting applications requiring high reliability wherein the lamp may be implemented as a tungsten-halogen lamp.

These objects are achieved, in one aspect of the invention, by provision of an incandescent lamp and operating circuit. The incandescent lamp includes a light-transmissive envelope hermetically enclosing an interior. There are first and second electrically conductive lead-in wires passing or running through the envelope and protruding into the interior. First and second lamp filaments are mounted within the interior. The filaments are electrically coupled with the lead-in wires such that the first filament is electrically in parallel with the second filament. The first filament is designed to operate at a first rated voltage, and the second filament is designed to operate at a second rated voltage. The second rated voltage is higher than the first rated voltage.

The operating circuit is employed in combination with the incandescent lamp. The operating circuit includes an inductive reactance electrically coupled with the first lead-in wire. The circuit also includes voltage-detection means for measuring the operating voltage across the lead-in wires of the lamp. There are means for coupling with an external source of electrical power.

An incandescent lamp and operating circuit in accordance with the invention will operate as follows. When the first filament of the lamp fails due to breakage or burnout, the second filament will automatically be fully activated. During lamp operation, a measurement by the voltage-detection means which returns a value equal to the first rated voltage indicates that both lamp filaments are operating. A measurement by the voltage-detection means which returns a value equal to the second rated voltage indicates that the first lamp filament has failed and only the second lamp filament is operational. Lamp replacement may occur at any time during the life of the second filament without any loss of service.

In a second aspect of the invention, there is the same incandescent lamp operating in combination with the same operating circuit as described in the first aspect of the invention except that the operating circuit does not necessarily contain voltage-detection (or voltage-measuring) means. Even though automatic means for detecting failure of the first filament may be absent, it is still advantageous to employ a lamp and operating circuit in accordance with the second aspect of the invention because the lamp is more reliable than its single-filamented counterpart. The second or backup filament provides an additional measure of protection against lamp failure due to a defect in the first filament.

Thus, in the first aspect of the invention, the operating circuit includes voltage-detection means. In the second aspect of the invention, which is broader than the first aspect, the operating circuit does not include voltage-detection means.

In yet another aspect of the invention, a method for designing an incandescent lamp and operating circuit is disclosed. The lamp has first and second terminals for coupling with an external source of electrical power and first and second filaments electrically in parallel between the terminals. The first filament is designed to operate at a first rated power and a first rated voltage. The second filament is designed to operate at a second rated power and second rated voltage. The second rated voltage is greater than the first rated voltage. The operating circuit has first and second terminals for coupling with the lamp terminals and third and fourth terminals for coupling with an external source of electrical power. The operating circuit includes an inductive reactance. The first and third terminals of the operating circuit are coupled through the inductive reactance. The second and fourth terminals of the operating circuit are directly coupled such that the second and fourth terminals are essentially at the same electrical potential. The operating circuit has an open circuit voltage measured between the third and fourth terminals of the operating circuit.

The design method comprises the following steps.

The first step includes formulating a first circuit equation for the lamp and operating circuit during the period when both filaments are operating. The first equation includes the inductive reactance and open circuit voltage as variables and the first rated power, first rated voltage, second rated power, and second rated voltage as parameters.

The second step includes a second circuit equation for the lamp and operating circuit during the period when the first filament has failed and the second filament is operating. The second equation includes the inductive reactance and open circuit voltage as variables and the first rated power, first rated voltage, second rated power, and second rated voltage as parameters.

The third step includes solving the first and second circuit equations simultaneously for the inductive reactance and open circuit voltage, both variables being in terms of the first rated power, first rated voltage, second rated power, and second rated voltage such that a first formula for uniquely determining a value of the inductive reactance and a second formula for uniquely determining a value of the open circuit voltage are derived.

The fourth step includes expressing the second rated voltage as a multiple of the first rated voltage, this multiple being a real number greater than one, and substituting the expression for the second rated voltage into the first and second derived formulas.

The fifth step includes selecting design values for the first rated power, first rated voltage, and second rated power.

The sixth step includes varying the multiple incrementally over a range and computing the total power consumed by the first and second filaments and the inductive reactance for each value of the multiple during the period when both filaments are operating. The increments are selected such that a desired precision of the multiple is obtained. The range includes a minimum value of the total consumed power (such that the value of total consumed power for one less or one greater increment of the multiple is greater than the minimum value). The computation of total consumed power employs the selected design values of first rated power, second rated power, and first rated voltage, as well as values of inductive reactance computed from the first derived formula.

The seventh step includes setting the optimum value of the multiple equal to the incremental value of the multiple corresponding to the minimum value of the total consumed power.

The eighth step includes determining the values of inductive reactance, open circuit voltage, and second rated voltage from the selected design values of first rated power, second rated power, first rated voltage, and optimum value of the multiple.

In a preferred embodiment of this design method, the first rated power and second rated power are equal.

BEST MODE FOR CARRYING OUT THE INVENTION

For a better understanding of the present invention, together with other and further objects, features, advantages, and capabilities thereof, reference is made to the following disclosure and appended claims taken in conjunction with the above-described drawings.

Figure 1:
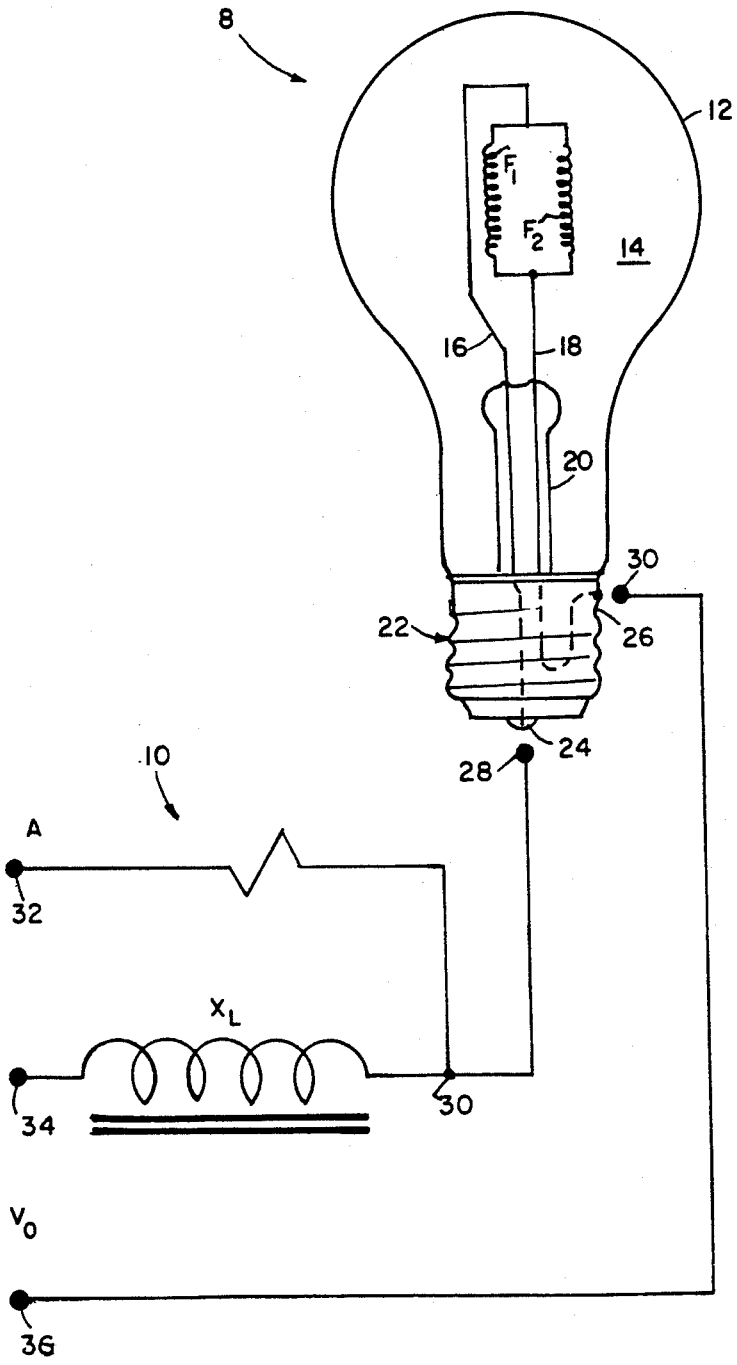
FIG. 1 shows an elevational view of an embodiment of a two-filamented lamp and a pictorial of an operating circuit in accordance with the invention. The values of inductive reactance and open circuit voltage of the operating circuit are matched with the rated power and operating voltages of both lamp filaments.

FIG. 1 shows double-filamented lamp 8 and operating circuit 10. Lamp 8 may be an incandescent lamp or a tungsten-halogen lamp. Lamp 8 includes light-transmissive envelope 12 hermetically enclosing interior 14. First and second electrically conductive lead-in wires 16 and 18, respectively, pass from the interior of base 22 through envelope 12 and stem 20 and protrude into interior 14. Base 22 may be a standard lamp base having first and second electrical terminals 24 and 26, respectively. Lead-in 16 is electrically connected to terminal 24, and lead-in 18 is electrically connected to terminal 26. First and second lamp filaments $F_1$ and $F_2$, respectively, are mounted within interior 14, for example, on stiff lead-in wires 16 and 18. The filaments are mounted such that $F_1$ is electrically in parallel with $F_2$, both filaments being connected electrically between the lead-in wires.

Operating circuit 10 has means for electrically coupling with lamp 8, such as socket terminals 28 and 30 which contact base terminals 24 and 26, respectively, when lamp 8 is mounted in an appropriate socket of circuit 10. Inductive reactance $X_L$ of circuit 10 is electrically coupled in series with lead-in 16 of lamp 8. Terminal 36 of circuit 10 is electrically coupled with lead-in 18 of lamp 8. $X_L$ is electrically between terminals 28 and 34 of circuit 10. Voltage-detection means A of circuit 10 may be a circuit connection tapping into circuit 10 at point 30 between $X_L$ and terminal 28. Terminals 34 and 36 of circuit 10 provide means for receiving electrical power from an external source. Open circuit voltage $V_o$ of circuit 10 may be measured across terminals 34 and 36. $V_o$ is measured looking through $X_L$ with lamp 8 in circuit 10. A voltage measurement made between terminals 32 and 36 with lamp 8 operating in circuit 10 provides a capability of ascertaining the present operating voltage of lamp 8 at a location remote from lamp 8.

In accordance with the invention, $F_1$ and $F_2$ are designed to operate at different voltages, the rated operating voltage of the second filament, $F_2$, being substantially higher than the rated operating voltage of the first filament, $F_1$. In lamp 8, both filaments have the same rated operating power which is preferred so that the luminous output of lamp 8 will not change appreciably after failure of the first filament. Thus, when $F_1$ operates at its rated voltage, it draws a substantially higher current than does $F_2$ operating at its rated voltage.

The inductive reactance and open circuit voltage of circuit 10 are chosen such that when both filaments of lamp 8 are intact, the high current of the first filament reduces the voltage at the lamp terminals to the rated value of the first filament. When this voltage is applied across the second filament, the second filament operates at a voltage substantially below its rated voltage. Consequently, the temperature of the second filament is low, and it does not consume any significant portion of its design life nor does it produce significant luminous output.

When the first filament of lamp 8 fails due to breakage or burnout, the current through the inductive reactance in circuit 10 drops to the lower value drawn by the second filament. Accordingly, there is a reduced voltage drop in the inductive reactance and the voltage at the lamp terminals increases to the rated voltage of the second filament. The second filament comes into full brilliance and serves as a fully equivalent substitute for the failed first filament.

The fact that the voltage at the lamp terminals has increased from the rated value of the first filament to the rated value of the second filament may be sensed by circuit connection A of circuit 10 and used to alert maintenance personnel, who may be situated remote from the site of the lamp, of the need to replace the lamp before failure of the second filament.

A lamp and operating circuit in accordance with the invention is particularly well suited to lighting applications where high reliability of service is required. In comparison to a prior art counterpart having a single filament, a lamp in accordance with the invention has a significantly increased useful life since the former needs to be replaced before failure of the filament for high service reliability whereas the latter will not be replaced until after failure of the first filament. In comparison to a prior art counterpart having two filaments, a lamp in accordance with the invention does not require costly on-site visual inspection of operating lamps to ascertain if replacement is appropriate nor is there a period of degraded luminous output after failure of the first filament during which the intended function of the lamp may be impaired.

In another aspect of the invention, connection A of circuit 10 is not present. It is, therefore, fully within the scope of the invention to omit connection A in circuit 10. In this case, there is no automatic capability for sensing the operating voltage across the terminals of lamp 8. Despite absence of voltage-detection means, it is still advantageous to employ a lamp and operating circuit in accordance with the invention where reliable service is required. The reserve filament provides an additional measure of protection against a lamp failure due to a defect in the first filament.

In a lighting system requiring high reliability and without voltage-detection means, lamps likely will be replaced routinely after a fixed period of operation. The fixed period may be the rated life, which is a statistical median meaning that fifty percent of lamps are expected to burn longer and fifty percent are expected to burn shorter than the rated life, or the fixed period may be shorter for higher reliability. Let $p_1$ be the probability that the first filament will burn over a fixed period. In the event the first filament does not burn for the full extent of the fixed period, let $p_2$ be the conditional probability that the second filament will burn for the remainder of the fixed period. TABLE I shows the respective probabilities for a single-filament or double-filament lamp of providing service over a fixed period (success) or of failing before expiration of the fixed period due to a filamentary defect or defects (failure).

TABLE I

| Filaments | Success | Failure |
|---|---|---|
| 1 | $p_1$ | $1 - p_1$ |
| 2 | $p_1 + (1 - p_1)p_2$ | $(1 - p_1)(1 - p_2)$ |

A lamp failure may occur for reasons other than a filament defect in which case an additional filament will not extend lamp life nor increase lamp reliability. On the other hand, a substantial percentage of lamp failures are caused by filamentary defects, particularly with signal lighting which typically is ignited frequently. In these cases, the second filament increases the probability that the lamp will operate over a fixed period as may be seen from TABLE I. With a second filament, the probability of success is increased by a positive factor of $(1-p_1)p_2$. Note that $p_2$ generally will be greater than $p_1$ because the applicable period for the second filament will be less than that of the first filament and no portion of the design life of the second filament is consumed during operation of the first filament. Where the fixed period is chosen such that $p_1$ is 0.9 (which is a typical relamp period), the probability of lamp failure is reduced from ten percent (with one filament) to less than one percent (with two filaments), an improvement by an order of magnitude. Alternatively, the increased reliability may permit enlargement of the fixed period and an associated reduction in maintenance costs.

The advantage of increased reliability of a two-filament lamp is realized whether or not voltage-detection means are included in the operating circuit. As will be explained in the design method below, the rated power of both filaments may be designed to be equal so that there will be no change or degradation in luminous output of the lamp after failure of the first filament.

The range of choices for a design or rated operating voltage for each filament of lamp 8 is quite broad. The only constraint is that the two rated voltages be sufficiently different such that the filament with the lower rated voltage always fails first. During the mutual lives of both filaments, the filament with the higher rated voltage must be operating at a voltage sufficiently below its rated voltage such that no significant portion of its design life will be consumed.

After the power and voltage ratings of the two filaments of lamp 8 have been selected, matched values of inductive reactance and open circuit voltage of circuit 10 may be uniquely determined. These matched values of $X_L$ and $V_o$ will insure that the lower rated voltage will be applied to the lamp when both filaments are operating and the higher rated voltage will be applied to the lamp when only the second filament is operating.

The following design method demonstrates the uniqueness with which the inductive reactance and open circuit voltage may be determined from the design properties of the two filaments. The derived formulas are provided below for illustration only. It is emphasized that the particular formulas are not critical to the invention. Numerous variations in the model (or underlying assumptions) are within the scope of the invention. For example, in the model described below the resistance of the second filament is assumed to be the same irrespective of whether the second filament is operating at the lower or higher rated voltage. This is clearly an approximation because the resistance of a filament generally increases as its temperature increases, and the temperature of the second filament is substantially cooler when the filament is operating at the lower rated voltage than when operating at its design voltage. The temperature dependence of the filament resistance could be incorporated into the model; however, this would not assist in teaching the principles of the invention. Another assumption incorporated into the model is that the power ratings of both lamp filaments are equal which, as explained previously, is preferred. On the other hand, the method will easily handle the situation where the two filaments have different power ratings. As will be evident, the essence of the method described below is in the approach rather than in the particular model employed.

Figure 2A:
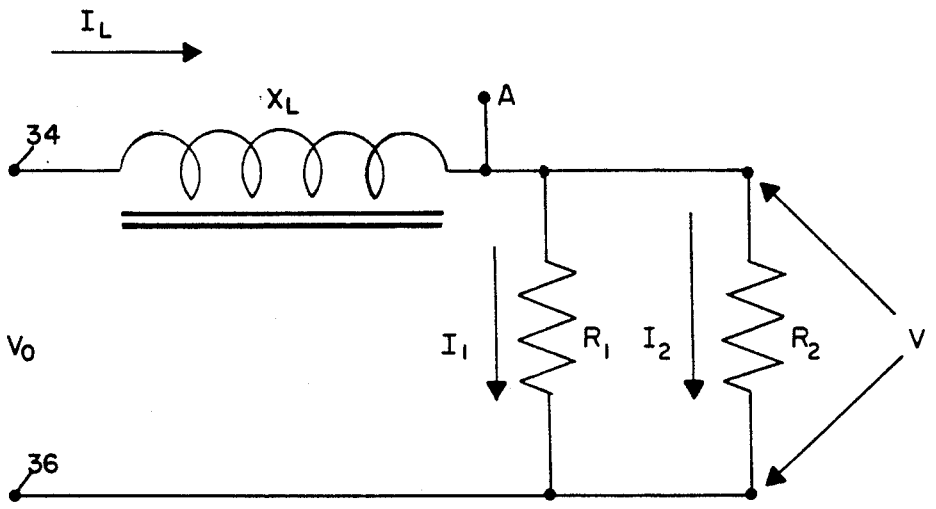
FIG. 2A is an electrical schematic of the lamp and operating circuit of FIG. 1 wherein both filaments are operating.

FIG. 2A is an electrical schematic of the lamp and operating circuit of FIG. 1 when both filaments are operating in the circuit. $R_1$ is the resistance of the first filament, and $R_2$ is the resistance (assumed to be constant) of the second filament. Let V be the design operating voltage of the first filament, and let kV be the design operating voltage of the second filament, where k is a real number greater than 1. In FIG. 2A, the voltage applied to both filaments is V, so that the first filament is operating at its rated voltage and the second filament is operating substantially below its rated voltage. Let P be the design power of both filaments. When P and V are specified, Rmay be determined as $V^2/P$ and $R_2$ may be determined as $(kV)^2/P$. Let $I_1$ be the current through the first filament; and $I_2$, the current through the second filament. $I_1$ may be determined as $V/R_1$, and $I_2$ may be determined as $V/R_2$. $I_L$, the current through the inductive reactance, may be determined as $I_1+I_2$. Applying the alternating current version of Ohm's law to the circuit of FIG. 2A yields:

$$V_o = I_L Z, \tag{1}$$

where Z is the electrical impedance of the circuit looking through circuit terminals 34 and 36. Let $R_E$ be the equivalent resistance of the parallel resistors, $R_1$ and $R_2$. It is well known that $R_E=R_1R_2/(R_1+R_2)$. Since $X_L$ and $R_E$ are in series, Z may be obtained as follows:

$$Z = \sqrt{X_L^2 + R_E^2}\,. \tag{2}$$

Substituting the expression for Z of equation (2) into equation (1) yields:

$$V_o = I_L\sqrt{X_L^2 + R_E^2}\,. \tag{3}$$

Equation (3) has two unknowns, $X_L$ and $V_o$.

Figure 2B:
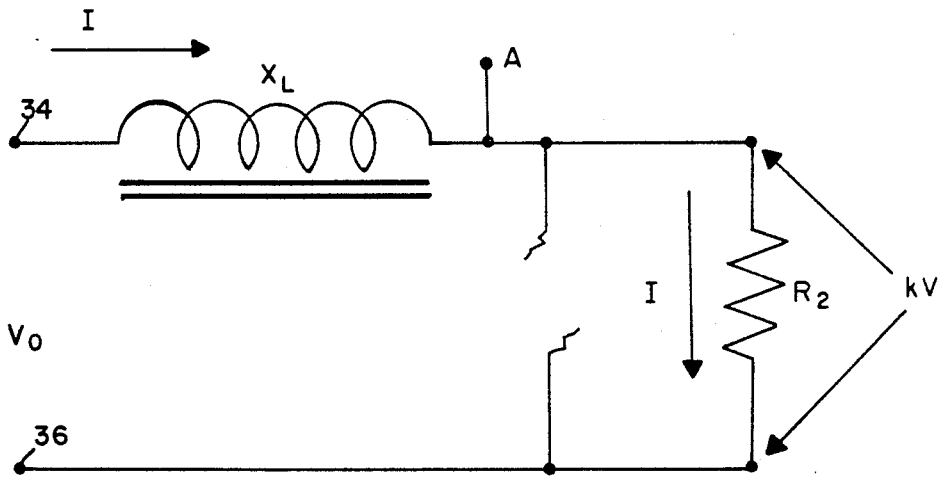
FIG. 2B is an electrical schematic of the lamp and operating circuit of FIG. 1 after the first filament has failed and the second filament is operating.

FIG. 2B is an electrical schematic of the lamp and operating circuit of FIG. 1 when only the second filament is operating. Now, the voltage applied to the lamp is kV, the rated voltage of the second filament. The current through $R_2$ is I, which may be determined by $kV/R_2$. Since $X_L$ and $R_2$ are in series, I is also the current through the inductive reactance, and the circuit impedance is:

$$Z = \sqrt{X_L^2 + R_2^2}\,. \tag{4}$$

Applying the alternating current version of Ohm's law to the circuit of FIG. 2B and substituting the expression of Equation (4) for Z yields:

$$V_o = I\sqrt{X_L^2 + R_2^2}\,, \tag{5}$$

where $X_L$ and $V_o$ are unknown.

Equations (3) and (5) are two independent quadratic equations in two unknowns, $X_L$ and $V_o$. These equations may be solved simultaneously, yielding formulas for $X_L$ and $V_o$ which can be expressed as follows:

$$X_L = R_1R_2\sqrt{\frac{k^2-1}{(R_1+R_2)^2 - k^2R_1^2}}\,, \tag{6}$$

and $$V_o = kV\sqrt{\frac{R_1^2(k^2-1)}{(R_1+R_2)^2 - k^2R_1^2} + 1}\,. \tag{7}$$

In FIG. 2A, the first filament operates at its rated power; hence $P=I_1^2R_1$, which yields $R_1=V^2/P$. In FIG. 2B, the second filament operates at its rated power; hence, $P=I^2R_2$, which yields $R_2=(kV)^2/P$. Substituting for $R_1$ and $R_2$ in Equations (6) and (7) yields the desired results:

$$X_L = \frac{(kV)^2}{P}\sqrt{\frac{k^2-1}{k^4+k^2+1}}\,, \tag{8}$$

and $$V_o = kV\sqrt{\frac{k^2-1}{k^4+k^2+1} + 1}\,. \tag{9}$$

The parameters k, V, and P are convenient because they depend on only the design characteristics of the two filaments, i.e., the rated voltages and power of each filament.

It is instructive to generate several examples from formulas (8) and (9). Suppose V=12 volts and P=72 watts (P is the same for both filaments). TABLE II contains values of $X_L$ and $V_o$ for k=2, 3, . . . , 10. There is, of course, no requirement that k be an integer. In TABLE II, $X_L$ entries are in ohms and $V_o$ entries are in volts.

TABLE II*

| k | $X_L$ | $V_o$ | $V_o/V$ |
|---|---|---|---|
| 2 | 3.024 | 25.657 | 2.14 |
| 3 | 5.337 | 37.549 | 3.13 |
| 4 | 7.501 | 49.301 | 4.11 |
| 5 | 9.600 | 61.096 | 5.09 |
| 6 | 11.667 | 72.939 | 6.08 |
| 7 | 13.714 | 84.819 | 7.07 |
| 8 | 15.750 | 96.724 | 8.06 |
| 9 | 17.778 | 108.648 | 9.05 |

TABLE II*-continued

| k | $X_L$ | $V_o$ | $V_o/V$ |
|---|---|---|---|
| 10 | 19.800 | 120.587 | 10.05 |

*V = 12 volts, P = 72 watts (both filaments)

The rightmost column of TABLE II contains the ratio $V_o/V$, which behaves like k as k increases, as may be seen from the table and Equation (9). This ratio characterizes the voltage stepdown factor imposed on the inductive reactance during the mutual lives of both filaments. The voltage stepdown factor after failure of the first filament is given by $V_o/(kV)$ which is always near 1 when k is greater than 1, as may be seen from Equation (9).

When k=2 and both filaments are intact, the first filament, operating at its design voltage and power, produces virtually all of the luminous output of the lamp and consumes 72 watts. The second filament operates at half of its rated voltage, generates virtually no luminous output, and consumes 18 watts. The total power consumed by the lamp during the mutual lives of the filaments is 90 watts, so that lamp efficacy has been reduced to 80% of the rated value of the first filament during this period. This reduction in lamp efficacy can be lessened by increasing the value of k.

When k=3 and both filaments are intact, the first filament, operating at its design voltage and power, produces virtually all of the luminous output of the lamp and consumes 72 watts. The second filament operates at one-third of its rated voltage and consumes 8 watts. The total power consumed by the lamp during the mutual lives of the filaments is 80 watts, so that lamp efficacy has been reduced to 90% of the rated value of the first filament during this period. Thus, the efficacy of the lamp while both filaments are operating is improved when a larger value of k is chosen because less power is wasted in the second filament.

Although lamp efficacy improves with higher k values during the period when both filaments are operating, this improvement must be balanced against increased energy dissipation in the inductive reactance or choke in the operating circuit. This power may be estimated as $(1-e)I^2X_L$, where e is the efficiency of the choke, i.e., the ratio of volt-amperes divided by power dissipation plus volt-amperes. As shown in the rightmost column of TABLE II, the voltage stepdown factor during the period when both filaments are operating grows linearly with k. In any application, a comparison of the improvement in lamp efficacy versus increased energy loss in the particular choke for increasing values of k should be made in order to choose an optimum value of k.

TABLE III*

| k | $P(F_1)$ | $P(F_2)$ | $P(X_L)$ | P(Total) |
|---|---|---|---|---|
| 2.0 | 72 | 18.00 | 17.01 | 107.01 |
| 2.2 | 72 | 14.88 | 18.38 | 105.25 |
| 2.4 | 72 | 12.50 | 19.72 | 104.22 |
| 2.6 | 72 | 10.65 | 21.05 | 103.70 |
| 2.8 | 72 | 9.18 | 22.38 | 103.56 |
| 3.0 | 72 | 8.00 | 23.72 | 103.71 |
| 4.0 | 72 | 4.50 | 30.48 | 106.98 |

*$X_L$ is 90% efficient

In order to illustrate the choice of optimum k, the following examples are provided. Table III shows that k=2.8 is an approximate optimum choice for lamp 8 of FIG. 1 where the inductive reactance is assumed to be 90% efficient. The second and third columns of the table contain the power consumed by the first and second filaments of lamp 8, respectively. The fourth column contains the power consumed or dissipated in the inductive reactance of circuit 10, i.e., 10% of $I_L^2X_L$ of FIG. 2A. The total power consumed by the system is the sum of the power consumed by both filaments and the inductive reactance; this value is contained in the rightmost column of TABLE III. All power entries in the table are in watts. An optimum value of k will minimize the total power consumption of the system. As is evident from TABLE III, the total power is a minimum when k=2.8, approximately.

If the cost of the inductive reactance is taken into account in the example of TABLE III, a choice of k somewhat less than 2.8, say 2.2 or 2.4, may be preferable. The cost of the inductive reactance is roughly proportional to the volt-amperes of the inductive reactance which, in this example, is ten times $P(X_L)$. As shown in the table, the increase in $P(X_L)$ between k=2 and k=3 is more sensitive than the relatively slight variation in P(Total) over the same range so that a slight reduction of the k value results in a significantly lower cost and near-optimum total power consumption. Thus, a choice of a somewhat lower k value than the theoretical optimum may be cost effective in a particular application.

TABLE IV is identical in structure to TABLE III, except here the inductive reactance is assumed to be 95% efficient. Examining the total system power consumed in the rightmost column of the table shows that total power consumed is a minimum when k=3.4, approximately.

TABLE IV*

| k | $P(F_1)$ | $P(F_2)$ | $P(X_L)$ | P(Total) |
|---|---|---|---|---|
| 2.0 | 72 | 18.00 | 8.50 | 98.50 |
| 3.0 | 72 | 8.00 | 11.86 | 91.86 |
| 3.2 | 72 | 7.03 | 12.53 | 91.56 |
| 3.4 | 72 | 6.23 | 13.20 | 91.43 |
| 3.6 | 72 | 5.56 | 13.88 | 91.44 |
| 3.8 | 72 | 4.99 | 14.56 | 91.55 |
| 4.0 | 72 | 4.50 | 15.24 | 91.74 |

*$X_L$ is 95% efficient

The essence of a design method in accordance with the invention is as follows. The method provides matched values of inductive reactance and open circuit voltage as functions of filamentary parameters. A first circuit equation is formulated describing the period when both filaments are operating. This equation reflects whatever models (and assumptions) of various circuit components are deemed to be appropriate for the desired precision of the results. A second circuit equation is formulated for the lamp and operating circuit describing the period after the first filament has failed (and therefore is no longer in the circuit) and the second filament is operating. The second equation likely employs the same models of circuit components as the first equation.

There are two independent equations in two unknowns, the unknowns being inductive reactance and open circuit voltage. The two equations are solved simultaneously to yield unique values of the unknowns in terms of filamentary parameters. Substitutions may be made in the derived formulas such that the filamentary parameters are those typically employed in filament design, such as rated power and operating voltage for each filament.

At this point, the operating circuit components are uniquely determined for selections of filamentary parameters, as long as the choice of operating voltage of the second filament is greater than that of the first filament. The design method, optionally, may be extended as follows. The rated voltage of the second filament is expressed as a multiple or ratio of the rated voltage of the first filament. This ratio is a number (not necessarily integral) greater than one. Using a variation of parameters technique, the value of the ratio is varied over a reasonable range to determine the effects on lamp efficacy and power lost in the inductive reactance during the period when both filaments are operating. An optimum value of the ratio is chosen such that the overall efficiency of the lamp and operating circuit is maximized. By permitting flexibility in the choice of value for the rated operating voltage of the second filament, an additional degree of freedom is obtained whereby optimization of overall energy loss may be attained.

Although the series inductor in the operating circuit reduces the overall efficacy of the lamp, it provides the additional advantage that the inductor reduces the "in-rush" current at switch-on which normally results from the low resistance of the filament when cold. In the absence of a current-limiting impedance, the peak current at switch-on can easily reach ten times the normal operating current. It is quite common for the in-rush current to cause failure of the filament at its thin spots. The inductive reactance typically will limit this in-rush current to less than twice the normal operating current of the first filament thereby reducing the incidence of lamp failure from this cause. For example, even if both filaments of lamp 8 have near-zero resistance, the maximum current through either filament would be less than $V_o/X_L$, the current passing through the inductive reactance. The corresponding entries of TABLE II show that for various values of k the maximum current is less than 1.5 times the design current for the first filament. Thus, the current limiting impedance is a particular advantage in signal lamps which are necessarily switched on many times in the course of their operating lifetimes.

In summary, this invention provides a double-filamented lamp having means of switching from a primary filament to a secondary filament upon failure of the primary filament. The means itself has extraordinary reliability, using no moving parts and only components that are themselves of very high reliability. The associated operating circuit may provide a positive electrical signal of the failure of the first filament in order to notify maintenance personnel of the need to replace the lamp before failure of the second filament.

While there have been shown what are at present considered to be preferred embodiments of the invention, it will be apparent to those skilled in the art that various changes and modifications can be made herein without departing from the scope of the invention as defined by the appended claims.

I claim:

1. An incandescent lamp and operating circuit comprising:

(a) an incandescent lamp including:

(i) a light-transmissive envelope hermetically enclosing an interior;

(ii) first and second electrically conductive lead-in wires running through said envelope and protruding into said interior;

(iii) first and second lamp filaments mounted within said interior, said filaments being electrically coupled with said lead-in wires such that said first filament is electrically in parallel with said second filament between said lead-in wires, said first filament being designed to operate at a first rated voltage, said second filament being designed to operate at a second rated voltage, said second rated voltage being higher than said first rated voltage; and (b) an operating circuit outside of said envelope including:

(i) an inductive reactance electrically coupled with said first lead-in wire;

(ii) voltage-detection means for measuring the operating voltage across said lead-in wires of said lamp; and (iii) means for coupling with an external source of electrical power;

(c) whereby a measurement by said voltage-detection means which returns a value equal to said first rated voltage indicates that both of said filaments are operating and a measurement by said voltage-detection means which returns a value equal to said second rated voltage indicates that said first filament has failed and only said second filament is operating.

2. A lamp and operating circuit as described in claim 1 wherein both of said filaments are designed to operate at approximately the same rated power.

3. A lamp and operating circuit as described in claim 2 wherein said rated power of both of said filaments is P, said first rated voltage is V, said second rated voltage is kV, where k is a number greater than one, said inductive reactance is $X_L$, the value of which approximately equals:

$$\frac{(kV)^2}{P}\sqrt{\frac{k^2-1}{k^4+k^2+1}},$$

and the open circuit voltage, looking through said inductive reactance and said lamp, is $V_o$, the value of which approximately equals:

$$kV\sqrt{\frac{k^2-1}{k^4+k^2+1}+1}.$$

4. A lamp and operating circuit as described in claim 3 wherein V is 12 volts, P is 72 watts, k is 2.8, $X_L$ is 4.891 ohms, and $V_o$ is 35.197 volts, all of said values being approximate values.

5. A lamp and operating circuit as described in claim 3 wherein V is 12 volts, P is 72 watts, k is 3.4, $X_L$ is 6.214 ohms, and $V_o$ is 42.248 volts, all of said values being approximate values.

6. A lamp and operating circuit as described in claim 1 wherein said voltage-detection means includes a circuit connection with said first lead-in wire.

7. A lamp and operating circuit as described in claim 1 wherein said lamp is a tungsten-halogen lamp.

8. A lamp and operating circuit as described in claim 1 wherein said second rated voltage is optimally related to said first rated voltage such that the sum of the power consumed by both of said filaments and said inductive reactance is approximately a minimum value.

9. An incandescent lamp and operating circuit comprising:

(a) an incandescent lamp including:

(i) a light-transmissive envelope hermetically enclosing an interior;

(ii) first and second electrically conductive lead-in wires running through said envelope and protruding into said interior;

(iii) first and second lamp filaments mounted within said interior, said filaments being electrically coupled with said lead-in wires such that said first filament is electrically in parallel with said second filament between said lead-in wires, said first filament being designed to operate at a first rated voltage, said second filament being designed to operate at a second rated voltage, said second rated voltage being higher than said first rated voltage; and (b) an operating circuit outside of said envelope including:

(i) an inductive reactance electrically coupled with said first lead-in wire; and (ii) means for coupling with an external source of electrical power;

(c) whereby said lamp will continue to provide luminous output after the failure of said first filament until the failure of said second filament.

10. A lamp and operating circuit as described in claim 9 wherein both of said filaments are designed to operate at approximately the same rated power.

11. A lamp and operating circuit as described in claim 10 wherein said rated power of both of said filaments is P, said first rated voltage is V, said second rated voltage is kV, where k is a number greater than one, said inductive reactance is $X_L$, the value of which approximately equals:

$$(kV)^2\sqrt{\frac{k^2-1}{k^4+k^2+1}},$$

and the open circuit voltage, looking through said inductive reactance and said lamp, is $V_o$, the value of which approximately equals:

$$kV\sqrt{\frac{k^2-1}{k^4+k^2+1}+1}.$$

12. A lamp and operating circuit as described in claim 11 wherein V is 12 volts, P is 72 watts, k is 2.8, $X_L$ is 4,891 ohms, and $V_o$ is 35.197 volts, all of said values being approximate values.

13. A lamp and operating circuit as described in claim 11 wherein V is 12 volts, P is 72 watts, k is 3.4, $X_L$ is 6.214 ohms, and $V_o$ is 42.248 volts, all of said values being approximate values.

14. A lamp and operating circuit as described in claim 9 wherein said lamp is a tungsten-halogen lamp.

15. A lamp and operating circuit as described in claim 9 wherein said second rated voltage is optimally related to said first rated voltage such that the sum of the power consumed by both of said filaments and said inductive reactance is approximately a minimum value.

16. A method for designing an incandescent lamp and operating circuit, said lamp having first and second terminals for coupling with an external source of electrical power and first and second filaments electrically in parallel between said terminals, said first filament being designed to operate at a first rated power and a first rated voltage, said second filament being designed to operate at a second rated power and second rated voltage, said second rated voltage being higher than said first rated voltage, said operating circuit having first and second terminals for coupling with said terminals of said lamp and third and fourth terminals for coupling with an external source of electrical power, said operating circuit including an inductive reactance, said first and third terminals of said operating circuit being coupled through said inductive reactance, said second and fourth terminals of said operating circuit being directly coupled such that said second and fourth terminals are essentially at the same electrical potential, said operating circuit having an open circuit voltage measured between said third and fourth terminals of said operating circuit, said method comprising the steps of:

(a) formulating a first circuit equation for said lamp and operating circuit during the period when both of said filaments are operating, said first equation including said inductive reactance and open circuit voltage as variables and said first rated power, first rated voltage, second rated power, and second rated voltage as parameters;

(b) formulating a second circuit equation for said lamp and operating circuit during the period when said first filament has failed and said second filament is operating, said second equation including said inductive reactance and open circuit voltage as variables and said first rated power, first rated voltage, second rated power, and second rated voltage as parameters;

(c) solving said first and second circuit equations simultaneously for said inductive reactance and open circuit voltage, both variables being in terms of said first rated power, first rated voltage, second rated power, and second rated voltage such that a first formula for uniquely determining a value of said inductive reactance and a second formula for uniquely determining a value of said open circuit voltage are derived;

(d) expressing said second rated voltage as a multiple of said first rated voltage, said multiple being a real number greater than one, and substituting said expression for said second rated voltage into said first and second formulas;

(e) selecting design values for said first rated power, first rated voltage, and second rated power;

(f) varying said multiple incrementally over a range and computing the total power consumed by said first and second filaments and said inductive reactance for each value of said multiple during the period when both of said filaments are operating, said increments being selected such that a desired precision of said multiple is obtained, said range including a minimum value of said total consumed power (such that the value of total consumed power for one less or one greater increment of said multiple is greater than said minimum value), said computation of total consumed power employing said selected design values of first rated power, second rated power, and first rated voltage, and values of inductive reactance computed from said first derived formula;

(g) setting the optimum value of said multiple equal to the incremental value of said multiple corresponding to said minimum value of said total consumed power; and (h) determining the design values of said inductive reactance, open circuit voltage, and second rated voltage from said selected design values of first rated power, second rated power, first rated voltage, and optimum value of said multiple.

17. A method as described in claim 16 wherein said first rated power and said second rated power are equal.

* * * * *